US006731191B2

(12) United States Patent
Lang et al.

(10) Patent No.: US 6,731,191 B2
(45) Date of Patent: May 4, 2004

(54) DC ELECTROMAGNET

(75) Inventors: Volker Lang, Bonn (DE); Rudolf Scholz, St. Augustin (DE)

(73) Assignee: Moeller GmbH, Bonn (DE)

( * ) Notice: Subject to any disclaimer, the term of this patent is extended or adjusted under 35 U.S.C. 154(b) by 0 days.

(21) Appl. No.: 10/407,793

(22) Filed: Apr. 4, 2003

(65) Prior Publication Data

US 2003/0189474 A1 Oct. 9, 2003

(30) Foreign Application Priority Data

Apr. 5, 2002 (DE) ..... 102 15 018

(51) Int. Cl.[7] ..... H01F 3/00; H01F 7/08

(52) U.S. Cl. ..... 335/255; 335/257; 335/261; 335/262; 335/279; 335/281

(58) Field of Search ..... 335/132, 255–281

(56) References Cited

U.S. PATENT DOCUMENTS 4,638,279 A 1/1987 Brisson et al. ..... 335/257

4,700,165 A 10/1987 Brisson et al. ..... 335/255

FOREIGN PATENT DOCUMENTS

| | | |
|---|---|---|
| DE | 2844361 | 4/1979 |
| DE | 3505724 | 8/1985 |
| IE | 48247 | 11/1984 |

*Primary Examiner*—Ramon M. Barrera
(74) *Attorney, Agent, or Firm*—Davidson, Davidson & Kappel, LLC

(57) ABSTRACT

A DC electromagnet system used in an electrical switchgear, for example in a contactor having a driving coil, includes a fixed, C-shaped magnet yoke and a movable, rod-shaped armature. The yoke has a central web and two legs. The armature is guided in its displacement stroke by guide devices, the free end of the armature being directed toward the central web of the magnet yoke. There is a single working air gap between the free end of the armature and the center of the central web, perpendicular to the longitudinal axis of the armature. The ends of the yoke legs extend to the proximity of the armature and are separated from the armature, each forming a parasitic air gap.

13 Claims, 1 Drawing Sheet

DC ELECTROMAGNET

This application claims priority to German Patent Application No. 102 15 018.4, which is hereby incorporated by reference herein.

The present invention relates to a DC electromagnet made of sheet metal magnet parts for use in an electric switchgear, in particular in a contactor having a driving coil.

BACKGROUND

There are DC electromagnets, used in contactors in particular, in various forms. If such electromagnets include two pairs of pole faces, for example, with a U-shaped magnet yoke having a rod-shaped armature which closes the magnet yoke or with E-shaped magnet parts, the relative positions of the pole face pairs must be adjusted. Furthermore, such electromagnets have at least two working air gaps which partly determine the power loss.

German Patent No. 35 05 724 C2 and U.S. Pat. No. 4,700,165 describe systems having an E-shaped fixed magnet core and an E-shaped movable magnet core. There are three pairs of pole faces and three working air gaps. The straight-line relative motion of the magnet cores with respect to each other without tipping must be ensured using guide devices. In particular, the ends of the lateral legs of the magnet cores are provided with angled surfaces resulting in self-alignment.

A similar system having E-shaped fixed and movable magnet cores is known from German Patent Application No. 28 44 361 A1. Also in this system the ends of the lateral legs of the magnet cores are angled and guide devices are used to stabilize the relative motion of the magnet cores with respect to each other.

SUMMARY OF THE INVENTION

An object of the present invention is to provide a DC electromagnet having a comparable power loss and functionality, reduced manufacturing costs, and the fewest possible number of magnet parts and a reduced number of pole face pairs.

The present invention provides a DC electromagnet system made of sheet metal magnet parts for use in an electrical switchgear, in particular in a contactor having a driving coil. The system comprises a fixed magnet yoke (10) formed by a central web (12) and two legs (11). The free ends (14, 14') of the magnet yoke legs (11) are situated spaced from one another forming a narrow passage (23) for a movable, prismatic armature (60). The armature (60) is guided in its displacement stroke by guide devices (40), the free ends (64) of the armature (60) being directed toward the central web (12) of the magnet yoke (10). A working air gap (22) is formed between the free end (64) of the armature (60) and the center of the central web (12), perpendicular to the longitudinal axis of the armature (60), the faces of the armature being inclined at an angle to the axis of the armature (60).

The present invention uses no E-shaped magnet bodies. In contrast with the above-named related art, there is only one working air gap.

Thus, according to the present invention, the fixed magnet yoke is designed in a ring shape or a C shape and includes a central web and two magnet yoke legs forming an angle with the central web. Furthermore, a single working air gap is formed between the free end of the movable prismatic armature and the center of the central web, perpendicular to the longitudinal axis of the armature; the two free leg ends of the magnet yoke extend to the proximity of the armature, where a narrow passage is formed for the armature.

In its displacement stroke, the armature is guided by guide devices. The free end of the armature is directed toward the central web of the magnet yoke and the faces of the working air gap are designed to form an angle with the armature's axis.

The narrow passage formed between the free ends of the magnet yoke legs and the armature represents another parasitic air gap, whose magnetic resistance does not change during displacement stroke movements.

A symmetrical design of the working air gap is preferred, in which the faces are wedge-shaped. The wedge shape of the working air gap is designed at the free end of the armature so that the wedge tip is in the plane of symmetry of the central web and the wedge is oriented toward the central web. Correspondingly, the wedge shape of the working air gap on the central web is designed as a wedge-shaped recess. The working air gap is provided with at least one stop made of non-magnetic material, the material forming the remanent air gap when the magnetic circuit is closed.

With the design of symmetrical, wedge-shaped faces in the working air gap, well-defined force relationships between armature and magnet yoke are achieved. No sideward tipping or slipping may occur on the angled surfaces, since a kind of self-centering takes place. With the wedge-shaped design, the effective magnetic surface and thus the magnetic energy in the air gap is intensified, in particular when the air gap is large.

In the following, "yoke profile" will be understood as the inner space formed by the inner surfaces of the lateral legs and of the central web. The face of the central web facing the yoke profile may be preferably designed without elevations or projections into the yoke profile. As an alternative, an extension web, which carries the wedge-shaped recess corresponding to the working air gap formed on the end of the armature, is designed on the central web of the magnet yoke.

An advantage of the above-described magnet system is that, compared to systems having a comparable drive volume and a comparable power loss, higher contact pressure forces are achievable. Furthermore, it is advantageous that the structure is made of stamped stacked metal sheets which may be welded or riveted. The drive may be easily assembled, because only few coupling elements are needed due to the symmetrical structure of the magnet system. The overall manufacturing costs are reduced.

In one of the embodiments, a free space that is as large as possible is created for the assembly of the driving coil. The design of the working air gap takes this requirement (first embodiment) into account in that the entire inner surface of the cross leg facing the magnet armature forms a single plane which has no material formations (elevations) protruding into the yoke profile, which might make the insertion of the driving coil difficult.

Embodiments of the present invention may differ by the length of the armature used and/or the position of the working air gap with respect to the central web of the magnet yoke.

BRIEF DESCRIPTION OF THE DRAWINGS

The present invention is elaborated upon below based on exemplary embodiments with reference to the drawings.

DETAILED DESCRIPTION

Figure 1:
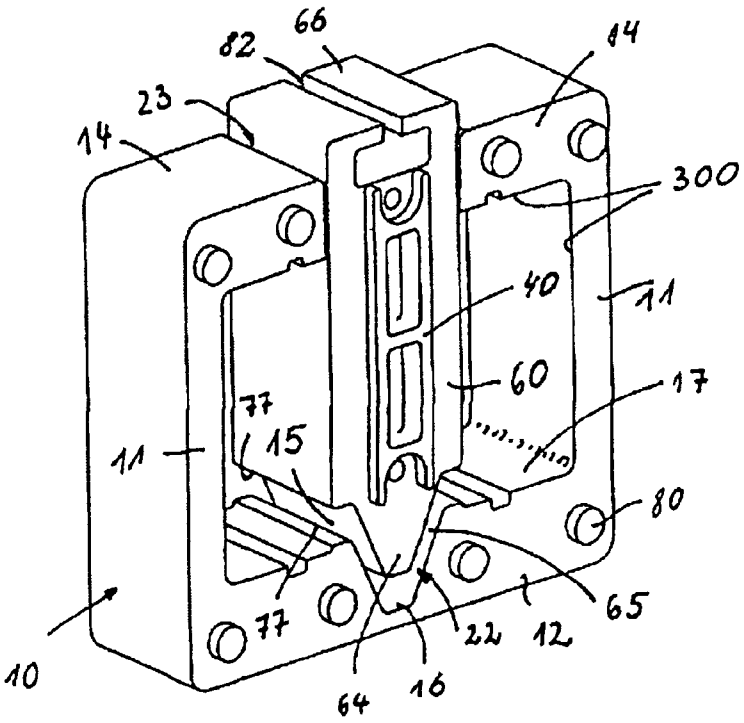
FIG. 1 shows a perspective view of a magnet system according to a first embodiment of the present invention having a long armature and a working air gap located deep in the central web of the magnet yoke.

The magnet parts (yoke 10 and armature 60) of the magnet system are made of stamped core stacks and have a rectangular cross-section. The stacks are riveted without a cover plate (rivets 80), which result in mechanical adhesion. This allows for cost-effective manufacture, which is not possible with manufacture using turned parts (in particular for the armature).

The fixed, ring-shaped or C-shaped magnet yoke 10, which includes two lateral legs 11 forming a right angle with central web 12 and thus being parallel to one another, is located in a housing (not shown). Ends 14 of lateral legs 11 are angled inward with respect to armature 60. The leg ends extend to the proximity of the magnet armature, where they form a narrow passage 23 for the armature. There is a parasitic air gap in the passage between the end of each leg and the armature. The width of the air gap is a few tenths of a millimeter. The observance of the air gap width is to be ensured during the movement of the armature using precision guide elements or—preferably—via a liner lamina made of non-magnetic material. The material (made of sheets or laminae) is applied to the air gap faces in the passage on magnet parts 14, 14', 60. The friction in passage 23 may be minimized using a friction-reducing material lining. The magnet armature is guided in its displacement stroke by guide devices 40.

Magnet armature 60 has a prismatic or rod shape. Its free end 64 is directed toward the center of central web 12 of the magnet yoke. Head end 66 of magnet armature 60 carries a groove 82 for insertion of coupling elements (not shown) for the drive mechanism. A restoring force may be produced by at least one spring.

Magnet armature 60 is surrounded by a driving coil (not shown) having a bobbin and an excitation winding. The magnet system is completed by the driving coil, which almost completely fills the space (yoke profile or inner profile 300) between central web 12, lateral legs 11, and leg ends 14 and inside which armature 60 is moved toward central web 12 of the magnet yoke. The magnet armature has an appropriate stroke in working air gap 22. The working air gap 22 is wedge-shaped or triangular.

The magnet system has a symmetric design with respect to a vertical plane of symmetry of the C-shaped magnet yoke.

Yoke profile 300 surrounded by magnet yoke 10 has a square or rectangular shape. In the embodiment according to FIG. 1, the cross-section formed by the yoke profile permits the driving coil (not shown), including the bobbin, to be easily inserted perpendicularly to the plane of symmetry of the magnet yoke.

In order to ensure a large free space for the driving coil, the working air gap is designed so that the entire inner face 17 of cross leg 12 facing the magnet armature forms a surface through which no elevation protrudes into yoke profile 300.

Figure 2:
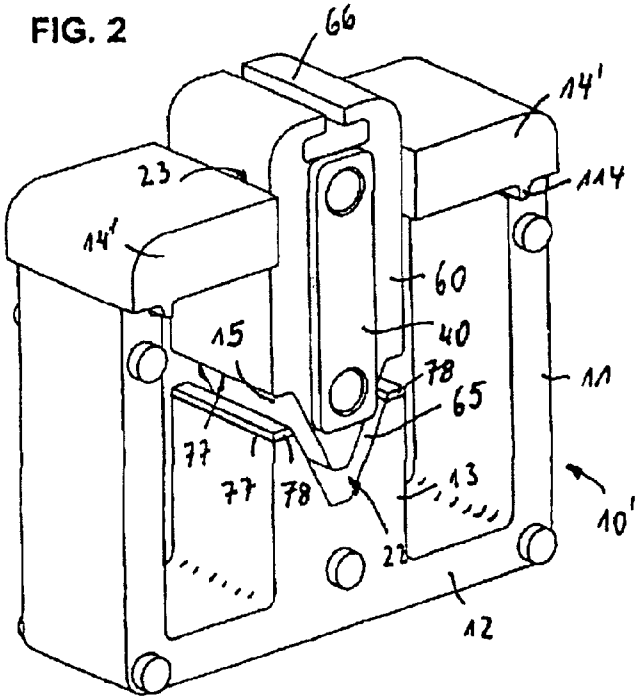
FIG. 2 shows a perspective view of a magnet system according to a second embodiment of the present invention having a shorter armature and a working air gap on the central web of the magnet yoke having an extended web.

The two embodiments according to FIG. 1 and FIG. 2 differ from one another in the length of the armature and the position of working air gap 22, as well as in the size of the winding space for the driving coil. In the embodiment according to FIG. 2, the yoke profile has a larger free space, since central web 12 may be designed with a minimum cross-section. An extension web 12 is designed on central web 12 of the magnet yoke. There is a wedge-shaped working air gap having a design similar to that of FIG. 1 between extension web and free end 64 of the armature.

In the DC electromagnet system according to FIG. 1, leg ends 14 are designed in one piece with magnet yoke 10. Entire magnet yoke 10 is composed of identical stamped metal sheets held together by rivets 80.

In the system of FIG. 2, leg ends 14' are made of magnetically conductive pieces (flux-conducting pieces) on magnet yoke 10 and fastened to lateral legs 11 using joints (not shown in detail). Flux-conducting pieces 14' having notches 114 may preferably be placed in grooves on the head side of side legs 11. The multi-piece design allows the driving coil to be installed in the magnet yoke before the magnet yoke is assembled.

As shown in FIG. 2, surfaces 77 are to be lined using stop laminae 78 made of a non-magnetic material (plastic or metal film, for example). Two stop laminae 78 may be situated symmetrically on the armature or on the magnet yoke or on both. The stop laminae 78 form a well-defined air gap thickness which prevents adhesion and provides the anti-remanence function of the air gap.

What is claimed is:

1. A DC electromagnet system for use in an electrical switchgear, the system comprising:

a fixed magnet yoke including a central web and two legs, the two legs including respective first free ends extending inward toward each other so as to form a passage therebetween; and an armature guided in a displacement stroke in the passage by a guide device, the armature including a second free end facing the central web and including a plurality of faces inclined at respective angles to an axis of the armature, the plurality of faces forming a working air gap with a central portion of the central web.

2. The DC electromagnet system as recited in claim 1 wherein at least one of the fixed magnet yoke and the armature include a sheet metal magnet part.

3. The DC electromagnet system as recited in claim 1 wherein the electrical switchgear includes a contactor having a driving coil.

4. The DC electromagnet system as recited in claim 1 wherein the plurality of faces are disposed in a wedge shape.

5. The DC electromagnet system as recited in claim 4 wherein a tip of the wedge shape lies in a plane of symmetry of the central web.

6. The DC electromagnet system as recited in claim 5 wherein the tip of the wedge shape is oriented toward the central web.

7. The DC electromagnet system as recited in claim 4 wherein the fixed magnet yoke defines a wedge-shaped recess.

8. The DC electromagnet system as recited in claim 1 wherein an inner face of the central web facing a yoke profile of the fixed magnet yoke has no elevations protruding into the yoke profile.

9. The DC electromagnet system as recited in claim 7 wherein the central web includes an extension web in central portion thereof, the wedge-shaped recess being defined by the extension web.

10. The DC electromagnet system as recited in claim 1 further comprising at least one stop lamina disposed between the fixed magnetic yoke and the armature, the at least one stop lamina including a non-magnetic material.

11. The DC electromagnet system as recited in claim 1 wherein the respective first free ends are integral with the fixed magnet yoke.

12. The DC electromagnet system as recited in claim 1 wherein the respective first free ends each includes a magnetically conductive piece.

13. The DC electromagnet system as recited in claim 1 further comprising a non-magnetic film material disposed on respective surfaces of the respective first free ends facing the armature.

* * * * *